United States Patent [19]

Watanabe et al.

[11] 4,264,537

[45] Apr. 28, 1981

[54] VARIABLE VENTURI TYPE CARBURETOR

[75] Inventors: Noboru Watanabe; Kiyohiko Oishi, both of Susono; Tokuta Inoue, Mishima, all of Japan

[73] Assignee: Toyota Jidosha Kogyo Kabushiki Kaisha, Toyota, Japan

[21] Appl. No.: 51,026

[22] Filed: Jun. 22, 1979

[30] Foreign Application Priority Data

Mar. 7, 1979 [JP] Japan ..... 54/25616

[51] Int. Cl.[3] ..... F02M 9/02

[52] U.S. Cl. ..... 261/44 C; 261/DIG. 74; 261/53; 123/439

[58] Field of Search ..... 261/44 C, 44 B, DIG. 74, 261/53; 123/119 EC

[56] References Cited

U.S. PATENT DOCUMENTS

| | | | |
|---|---|---|---|
| 1,421,627 | 7/1922 | Waterhouse | 261/44 B |
| 3,931,814 | 1/1976 | Rivere | 261/DIG. 74 |
| 4,130,095 | 12/1978 | Bowler et al. | 261/DIG. 74 |
| 4,132,203 | 1/1979 | Elpern et al. | 261/DIG. 74 |
| 4,185,054 | 1/1980 | Nakamura et al. | 261/44 C |

FOREIGN PATENT DOCUMENTS

| | | | |
|---|---|---|---|
| 421485 | 11/1925 | Fed. Rep. of Germany | 261/44 B |
| 504607 | 3/1929 | Fed. Rep. of Germany | 261/44 B |
| 2106501 | 8/1971 | Fed. Rep. of Germany | 261/44 C |
| 47-1144 | 1/1972 | Japan | 261/44 C |
| 16926 | of 1912 | United Kingdom | 261/44 B |
| 152442 | 10/1920 | United Kingdom | 261/44 B |

*Primary Examiner*—Tim R. Miles

*Attorney, Agent, or Firm*—Stevens, Davis, Miller & Mosher

[57] ABSTRACT

A variable venturi type carburetor of an internal combustion engine which includes a housing, a bore extending through the housing and having an inner wall defining an intake passage, a suction piston movably mounted in the housing and having a head portion projecting into the intake passage and a fuel injection valve arranged at the position opposite to the head portion of the suction piston with regard to the intake passage. The suction piston moves so as to change the cross-sectional area of the venturi portion defined between the head portion of the suction piston and an inner wall of the intake passage. The head portion of the suction piston is provided with a recess which extends along a line crossing with the central axis of the suction piston and is arranged in parallel to the direction of air flowing in the intake passage.

6 Claims, 6 Drawing Figures

VARIABLE VENTURI TYPE CARBURETOR

BACKGROUND OF THE INVENTION

This invention relates to a carburetor of an internal combustion engine, and more particularly relates to a variable venturi type carburetor having a fuel injection valve in which, during low-load operation with a low amount of suction fuel, the atomization or mixing characteristic is improved and the change in the amount of fuel being fed into the engine combustion chambers is reduced.

A variable venturi type carburetor having a fuel injection valve comprises a suction piston movably mounted on a venturi portion of an intake passage, so as to vary the cross-sectional area of the venturi in accordance with the change in the amount of air being fed to the engine combustion chambers. As is well-known, the cross-sectional area of the venturi portion is controlled so that the velocity of air flowing in the venturi, that is, the vacuum level in the venturi, is always maintained at a constant value. Fuel is injected into the venturi portion from the fuel injection valve provided in the vicinity of the venturi portion, and atomized so as to be mixed with sucked air. The fuel injection valve is usually controlled electrically in accordance with the running conditions of the engine, such as, the amount of sucked air, the rate of engine revolution speed, the temperature of sucked air, the temperature of engine cooling water and so on; and/or in accordance with the running conditions of the engine measured by the signals form an $O_2$ sensor provided in an exhaust passage, so that the necessary amount of fuel is supplied wherein the actual air-fuel ratio of the mixture is in the vicinity of the so called theoretical air fuel-ratio.

In a variable venturi type carburetor having a fuel injection valve, the speed of the fuel injected from the fuel injection valve is constant, since the speed of the sucked air flowing through the venturi portion is always constant, and the pressure of injected fuel and the absolute pressure in the venturi portion are also constant. Therefore, the streamline of the injected fuel draws a certain curve along which the fuel is sucked downwardly in the intake passage. In addition, as the fuel injection valve is actuated and electrically controlled with the signal pulse, the fuel injection takes place periodically.

In a conventional variable venturi type carburetor, as the surface of the head portion of the suction piston which defines the cross-sectional area of the venturi portion is flat, during low-load operation with a low amount of sucked air wherein the cross-sectional area of the venturi portion is small, the distance from an injection nozzle of the fuel injection valve to the head portion of the suction piston is relatively small, so that the injected fuel may be attached on the head portion of the suction piston and fall in drops downwardly in the intake passage. As a result, a rich mixture and lean mixture are alternately supplied into the combustion chambers of the engine, so that smooth operation of the engine is disturbed. In addition, during the low load operation of the engine, the cross-sectional area of the venturi portion has a shape of an elongated rectangular or semi-circular slit, so that the rate of mixing of air and fuel at the central part of the intake passage is different from the rate at the peripheral part of the passage. Consequently, a homogeneous mixture of air and fuel cannot be obtained, the fuel combustion in the engine cannot be stabilized and misfires may occur, so that smooth operation of the engine is disturbed. Further, the rate of fuel consumption during the low load operation increases, so that a large quantity of noxious substances, such as hydrocarbons (HC) and carbon monoxide (CO) are contained, in the exhaust gas.

SUMMARY OF THE INVENTION

An object of this invention is to provide a variable venturi type carburetor of an internal combustion engine capable of overcoming the defects mentioned above.

Another object of this invention is to provide a variable venturi type carburetor of an internal combustion engine capable of preventing the fuel injected from a fuel injection valve from colliding with a head portion of a suction pistion and being sucked in drops downwardly in an intake passage, during the low load operation of engine, reducing the variation of the amount of fuel being supplied into the engine combustion chambers and improving the stability of the engine revolution.

A further object of this invention is to provide a variable venturi type carburetor of an internal combustion engine capable of improving the atomization characteristic of fuel injected from a fuel injection valve so as to be homogeneously mixed with air, improving the combustion characteristic of the engine, reducing the rate of fuel consumption and reducing noxious combustible substances, such as HC and CO, contained in the exhaust gas.

According to the present invention, there is provided a variable venturi type carburetor, comprising: a housing; a bore extending through said housing and having an inner wall defining an intake passage; a suction piston movably mounted in said housing and having a head portion projecting into said intake passage, said head portion of the suction piston and said inner wall of the intake passage defining a venturi, said suction piston moving so as to change the cross-sectional area of said venturi in response to a change in the vacuum produced in said intake passage downstream of said venturi at a constant value; a fuel injection valve arranged at the position opposite to said head portion of the suction piston with regard to said intake passage, said fuel injection valve being controlled so as to inject the necessary amount of fuel into said intake passage in response to the engine running conditions, and; said head portion of the suction piston having a recess which extends and passes through the center axis of the suction piston and is arranged in parallel to the direction of air flowing in said intake passage. It is advantageous that the recess have such side walls and a bottom wall that the width and depth of the recess is gradually increased toward the downward area from the central portion of the suction piston. It is also advantageous that the side walls of the recess curve in streamline shape.

BRIEF DESCRIPTION OF THE DRAWINGS

The present invention may be more fully understood from the description set forth below of preferred embodiments of the present invention, together with the accompanying drawings, wherein.

DESCRIPTION OF PREFERRED EMBODIMENTS

Figure 1:
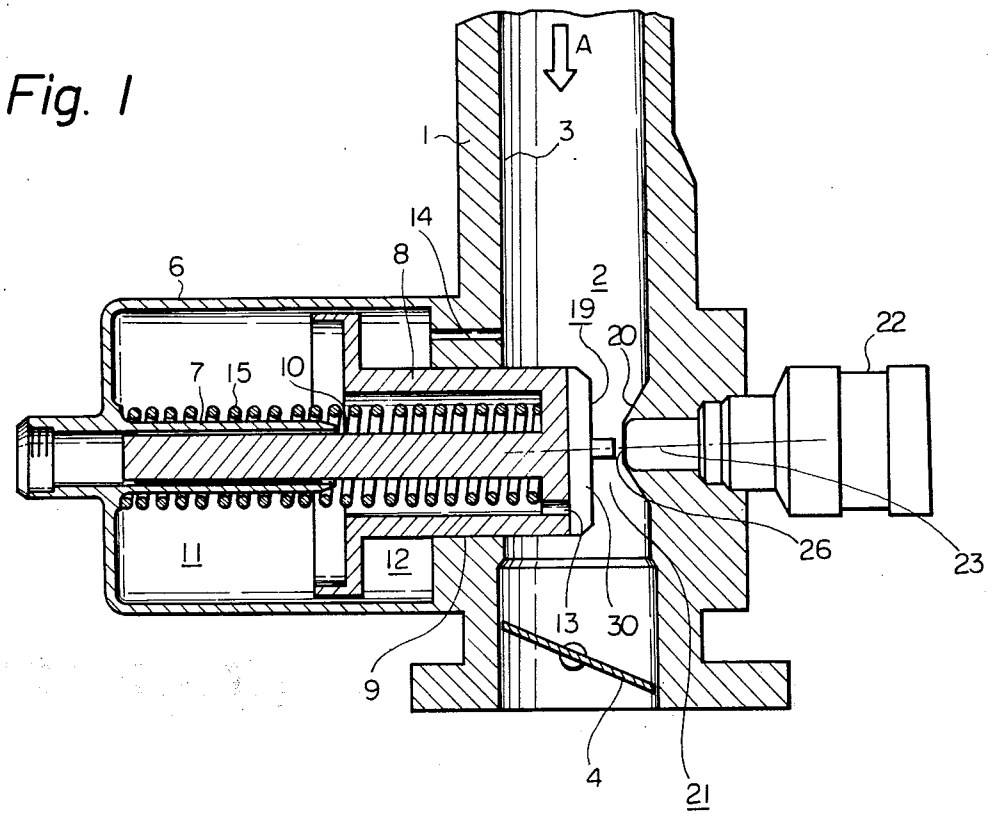
FIG. 1 is a cross-sectional view of a variable venturi type carburetor of an internal combustion engine of the present invention.

Referring now to FIG. 1, a carburetor body 1 has a bore 3 which defines an intake passage 2 therein. Reference numeral 4 designates a throttle valve. The introduced air flows in the intake passage 2 in the direction shown by the arrow A. Reference numeral 6 designates a housing or outer casing, which has a hollow cylindrical guide 7 extending in the central portion of the inside of the outer casing 6. Reference numeral 8 designates a suction piston which is secured and slidingly guided within a guide hole 9 formed in the carburetor body 1 and has a piston rod 10 extending in the left direction in FIG. 1. The piston rod 10 is also secured and slidingly guided within the hollow cylindrical guide 7. A vacuum chamber 11 and an atmospheric pressure chamber 12, which are separated by the suction piston 8, are formed in the outer casing 6. The vacuum chamber 11 is connected to the intake passage 2 downstream of a venturi portion 21 via a suction hole 13; thus, a vacuum is produced in the vacuum chamber 11. On the other hand, the atmospheric pressure chamber 12 is connected to the intake passage 2 upstream of the venturi portion 21 via an air hole 14; thus, the pressure in the atmospheric pressure chamber 12 is maintained at approximately atmospheric pressure. A compression spring 15 is disposed between the suction piston 8 and the outer casing 6. The suction piston 18 is always biased in the axial direction due to the spring force of the compression spring 15.

The suction piston 8 has a head portion 19 which projects from the bore wall 3 of the carburetor body 1 into the intake passage 2. Between the end face of the head portion 19 and an inner wall 20 of the bore 3 opposite to the head portion a venturi portion 21 is formed, the cross-sectional area of which is variable. A fuel injection valve 22 is arranged at the position opposite to the suction piston 8 in relation to the intake passage 2 of the carburetor body 1. According to the embodiment shown in FIG. 1, the fuel injection valve 22 is so arranged that the central axis thereof is substantially the same as the central axis 23 of the suction piston 8.

Figure 2:
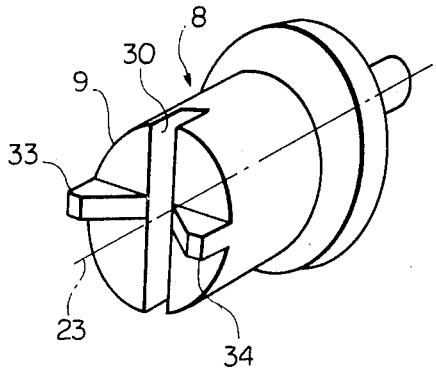
FIG. 2 is a perspective view of a suction piston according to an embodiment of the present invention.
Figure 3:
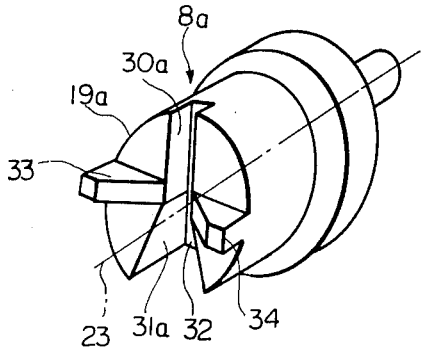
FIG. 3 is a perspective view of a suction piston according to another embodiment of the present invention.
Figure 4:
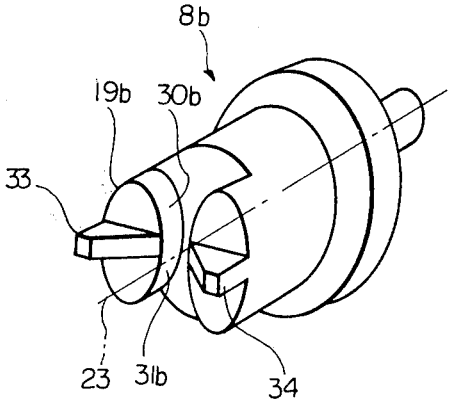
FIG. 4 is a perspective view of a suction piston according to a further embodiment of the present invention.

Embodiments of the suction piston are respectively illustrated in FIGS. 2, 3 and 4 in perspective views. In FIGS. 1 and 2, the head portion 19 of the suction piston 8 is provided with a recess 30 which extends along a line crossing with the central axis 23 of the suction piston 8 and is arranged in parallel to the direction A (see FIG. 1) of air flowing in the intake passage 2. In addition, the head portion 19 of the suction piston 8 is also provided with V-shaped fins 33 and 34 which are arranged symmetrically with respect to an imaginary surface passing through the central axis 23 of the suction piston 8 and extending along the direction A of air flowing in the intake passage 2. The V-shaped fins 33 and 34 are formed, as shown in FIGS. 2 through 4, by two projected fin members which are constructed integrally with the suction piston 8 and are arranged at both sides of the above mentioned recess 30.

According to an embodiment shown in FIG. 3, a head portion 19*a* of a suction piston 8*a* has two V-shaped fins 33 and 34, similar to the embodiment shown in FIG. 2, but has a recess 30*a* with a shape that is differenct from that of the embodiment shown in FIG. 2. That is to say, the head portion 19*a* of the embodiment shown in FIG. 3 has the recess 30*a* with such side walls 31*a* that the width of the recess is gradually increased toward the downward area from the central portion of the suction piston 8*a*. In addition, according to the embodiment shown in FIG. 3, the recess 30*a* has such a bottom wall 32 that the depth of the recess 30*a* is gradually increased toward the downstream area from the central portion of the suction piston 8*a*.

According to an embodiment shown in FIG. 4, a recess 30*b* has such side walls 31*b* that the width of the recess 30*b* is gradually increased toward the downstream area and toward the upstream area from the central portion of the suction piston 8*b*. The side walls 31*b* of the recess 30*b* curve in a streamline shape.

The operation of the variable venturi type carburetor of the present invention will now be described. In FIG. 1, as is known to those skilled in the art, the suction piston 8 moves toward the right and left due to the difference between the pressure in the atmospheric pressure chamber 12 and the vacuum in the vacuum chamber 11, and the cross-sectional area of the venturi portion 21 is varied so that the velocity of air flowing in the venturi portion 21 is maintained at a constant value. Since the velocity of air flowing in the venturi portion 21 is always maintained at a constant value without regard to the amount of air flowing in the venturi portion 21, a vacuum of a constant level, for example 100 through 200 mmAq, is always produced in the venturi portion 21.

The fuel injection valve 22 is controlled electrically in accordance with the running conditions of the engine, such as, the amount of sucked air, the engine revolution speed, the temperature of sucked air, the temperature of engine cooling water and so on, and in accordance with the running conditions of the engine measured by the signals from an $O_2$ sensor provided in an exhaust passage. Thus, the necessary amount of fuel to be injected is determined in accordance with these engine running conditions, and the fuel injection valve 22 is actuated with certain intervals of signals so as to inject the necessary amount of fuel. Therefore, the necessary amount of fuel is periodically injected from a nozzle injection port 26 of the fuel injection valve 22 into the intake passage 2.

Fuel is injected with a certain extension (a certain injection angle) from the nozzle injection port 26 of the fuel injecton valve 22. According to a conventional variable venturi type carburetor, however, during the low-load operation of the engine, the cross-sectional area of the venturi portion has a shape like an elongated rectangular or semi-circular slit, as shown by the hatched portion X in FIG. 5. This is because n recesses, fins, or the like are provided on the head portion of the suction piston. As a result, the amount of fuel being supplied varies and there is a non-homogeneous mixing of air and fuel.

Figure 5:
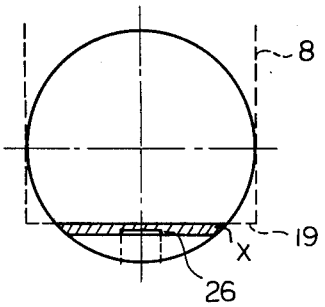
Fig. 5 (PRIOR ART)
FIG. 5 is a schematic view illustrating a cross-sectional area of a venturi portion of a conventional variable venturi type carburetor.
Figure 6:
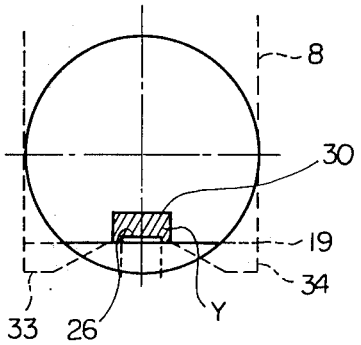
FIG. 6 is a schematic view illustrating a cross-sectional area of a venturi portion of a variable venturi type carburetor of the present invention.

According to the variable venturi type carburetor of the present invention, during the low load operation of the engine (during the same engine conditions as the case shown in FIG. 5), the cross-sectional area of the venturi portion 21 (FIG. 1) has a rectangular shape as shown by the hatched portion Y in FIG. 6, which is the same size as the hatched portion X in FIG. 5. This is because the head portion 19 of the suction piston 8 is provided with a recess 30 and V-shaped fins 33 and 34. The air sucked into the intake passage 2 in the direction shown by the arrow A is concentrated in the rectangular cross-sectional area Y when it passes through the venturi portion 21 of the intake passage 2. Therefore, the fuel injected from the injection nozzle port 26 of the fuel injection valve 22 is advantageously and homogeneously mixed with the air. In addition, the injected fuel does not directly touch the head portion 19 of the suction piston 8, but escapes around the bottom wall and the side walls of the recess 30, so that the injected fuel may not be attached on the suction piston 8. This results in preventing the variation of the rate of engine revolution speed caused by the fuel falling in drops.

During the middle or heavy load operation of the engine, when the sucked air flows through the venturi portion 21, the air is also concentrated around the fuel injection port 26 of the fuel injection valve 22 by means of the V-shaped fins 33 and 34, which results in an advantageous mixing characteristic of fuel and air.

The embodiments shown in FIGS. 3 and 4 have an effect that the sucked air concentrated around the fuel injection port 26 at the venturi portion 21 and/or the atomized mixture flow more smoothly.

What we claim is:

1. A variable venturi type carburetor of an internal combustion engine, said carburetor comprising:

a housing;

a bore extending through said housing and having an inner wall defining an intake passage;

a suction piston movably mounted in said housing and having a head portion projecting into said intake passage, said head portion of the suction piston and said inner wall of the intake passage defining a venturi, said suction piston moving so as to change the cross-sectional area of said venturi in response to a change in the vacuum produced in said intake passage downstream of said venturi at a constant value;

a fuel injection valve arranged at the position opposite to said head portion of the suction piston with regard to said intake passage, said fuel injection valve being electrically controlled so as to positively and directly inject the necessary amount of fuel into said intake passage in response to the engine running conditions from the opposite position without the need for venturi vacuum;

said head portion of the suction piston having a recess therein which extends along a line crossing with the center axis of the suction piston and parallel to the direction of air flowing in said intake passage; and said head portion of the suction piston also having two fin members projecting therefrom, said fin members being on opposite sides of said recess and symmetrically disposed with respect to an imaginary surface passing through the central axis of said suction piston and extending along the direction of air flowing in said intake passage, said fin members defining a V-shaped passage therebetween.

2. A variable venturi type carburetor as set forth in claim 1, wherein said recess has such side walls that the width of said recess is gradually increased toward the downward area from the central portion of the suction piston.

3. A variable venturi type carburetor as set forth in claim 2, wherein said side walls of the recess curve in streamline shape.

4. A variable venturi type carburetor as set forth in claim 1, wherein said recess has such side walls that the width of said recess is gradually increased toward the upward area as well as toward the downstream area from the central portion of the suction piston.

5. A variable venturi type carburetor as set forth in claim 4, wherein said side walls of the recess curve in streamline shape.

6. A variable venturi type carburetor as set forth in any one of claims 2 through 5 and 1, wherein said recess has such a bottom wall that the depth of the recess is gradually increased toward the downstream area from the central portion of the suction piston.

* * * * *